United States Patent [19]

Tsujimoto

[11] 4,441,860

[45] Apr. 10, 1984

[54] WATER LEVEL DETECTOR APPARATUS OF FLOAT TYPE

[76] Inventor: Haruo Tsujimoto, 16-39, 4-Chome, Tsurumi, Tsurumi-Ku, Osaka-shi, Japan

[21] Appl. No.: 353,439

[22] Filed: Mar. 1, 1982

[51] Int. Cl.[3] ..... F04B 49/04

[52] U.S. Cl. ..... 417/40; 200/84 C

[58] Field of Search ..... 417/40, 44; 200/84 C, 200/81.9 M; 73/308, 313; 137/397, 398

[56] References Cited

U.S. PATENT DOCUMENTS

| | | | |
|---|---|---|---|
| 3,316,845 | 5/1967 | Schumann | 417/40 |
| 3,684,400 | 8/1972 | Einerson et al. | 417/40 |
| 4,345,879 | 8/1982 | Steiner | 417/40 |

*Primary Examiner*—Edward K. Look

*Attorney, Agent, or Firm*—McGlew and Tuttle

[57] ABSTRACT

An apparatus comprising a float vertically movable in a case, a driven member fitting to the float and having a movable attracting portion, upper and lower fixed attracting members disposed above and below the portion in opposed relation thereto, a stopper provided at a lower portion of the driven member for supporting the load of the float, a reed switch magnetically operable by the approach or retreat of the movable portion, and a contactless switching element consisting essentially of a TRIAC and operable by the reed switch. The reed switch is instantaneously opened or closed and held opened or closed when water level reaches an upper limit or lower limit. The apparatus is useful for automatically controlling underwater pumps.

11 Claims, 15 Drawing Figures

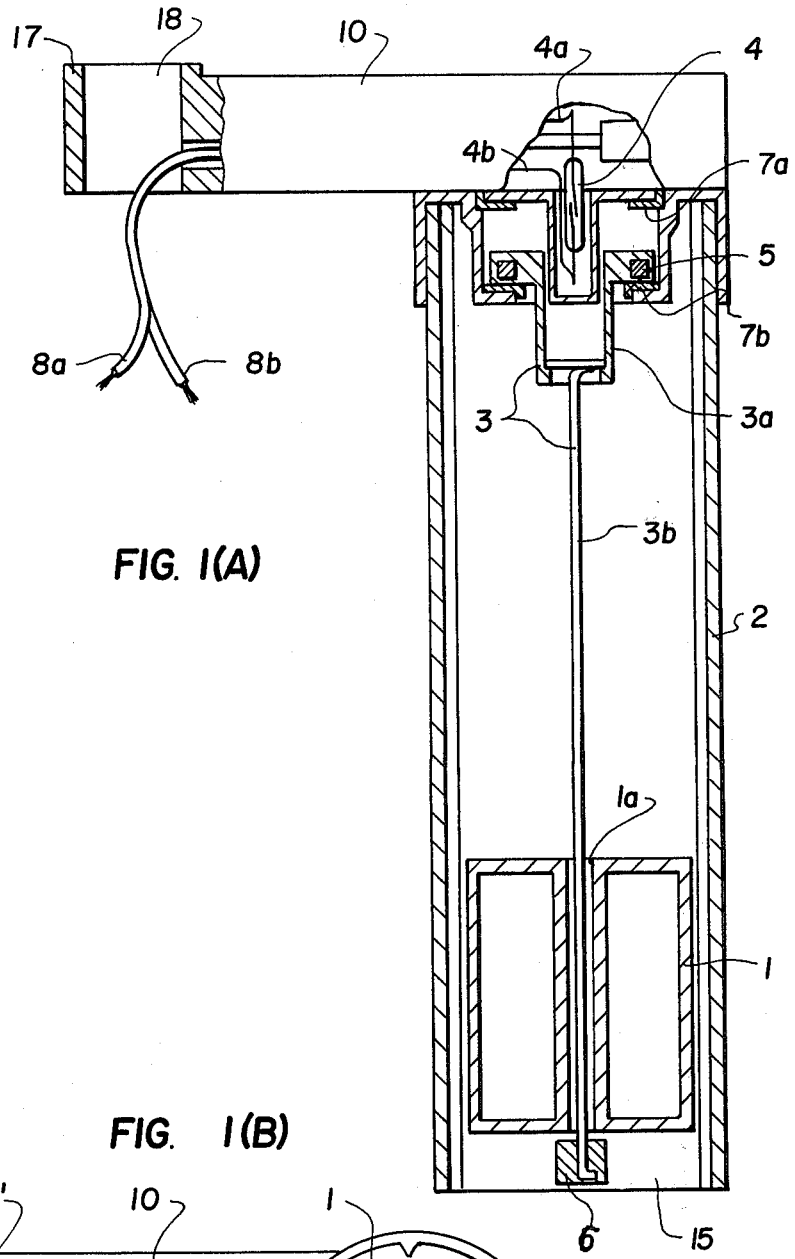
FIG. 1(A)
FIG. 1(B)
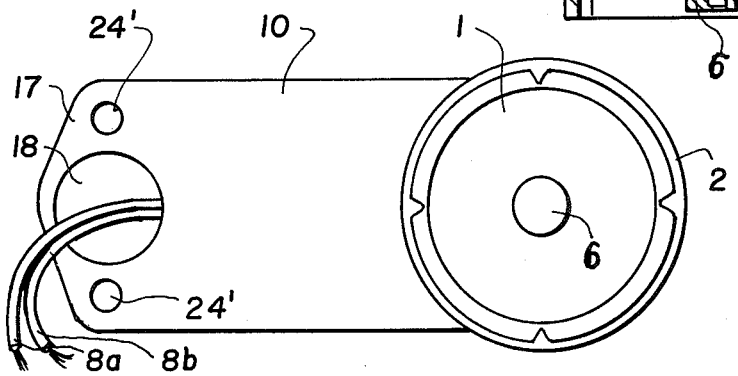

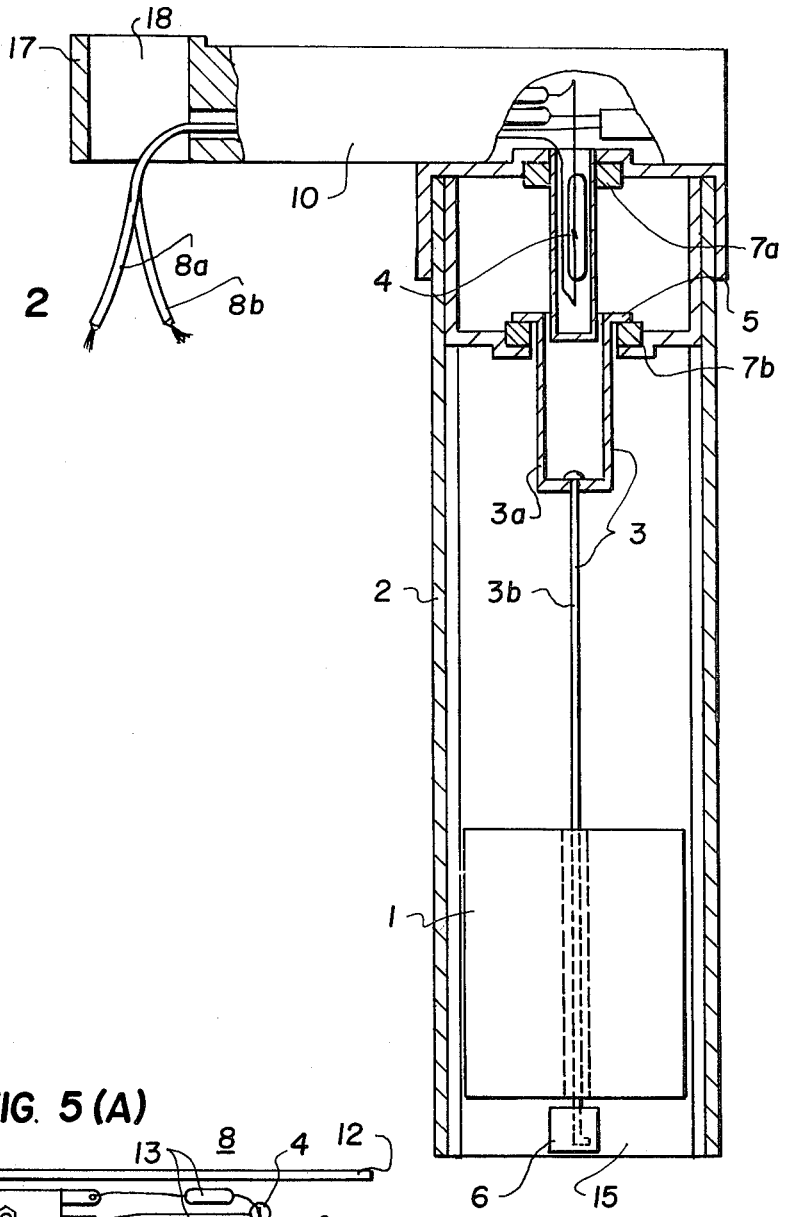
FIG. 2
FIG. 5 (A)
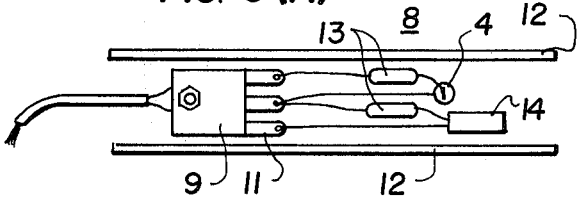
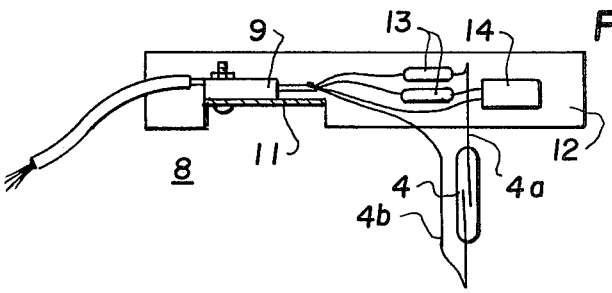
FIG. 5 (B)

Controllable Range
1
2
3
4
5
6
7a
7b
15

Controllabe Range $\ell_2$

WATER LEVEL DETECTOR APPARATUS OF FLOAT TYPE

FIELD AND BACKGROUND OF THE INVENTION

The present invention relates to a water level detecting apparatus of the float type for reliably detecting water level at two positions, namely at a predetermined upper limit and a predetermined lower limit, and more particularly to such an apparatus which is suitable for automatically controlling underwater pumps.

Conventional water level detectors for controlling the operation of underwater pumps, as shown in FIGS. 8A and 8B comprise a float 1″ upwardly or downwardly movable along a guide 2″ in accordance with the water level, a magnet 5′ provided on the float 1″ and a reed switch 4′ disposed within the guide 2″. When the float 1″ reaches a predetermined upper limit or lower limit, the magnet 5′ closes the reed switch 4′ as shown in FIG. 8A. The switch 4′ is opened when the magnet 5′ moves away therefrom with a fall or rise of the water level as seen in FIG. 8B. The operation of the reed switch 4′ is transmitted to the motor circuit of the pump by way of a transformer and power relay. With such an apparatus, the magnet 5′ moves away from the reed switch 4′ to stop the pump when the water level lowers from the upper limit even if slightly, so that the range over which the water level is controllable is very small and indefinite. The apparatus therefore has the drawback that waves on the water surface cause chattering. Further for controlling the operation of the underwater pump, there is the need to use two water level detectors for starting the pump at the upper limit and stopping the pump at the lower limit. This requires a complex arrangement outside the pump and is costly. Further since it is impossible to incorporate into the detecting apparatus the transformer and power relay which requires a large space, these components must be housed in the head cover of the pump motor. The cover needs to be correspondingly larger, consequently rendering the motor large-sized. If it is attempted to modify a non-automatic pump to an automatic pump, there arises the necessity of preparing a new head cover. The labor and expenditure then needed will be unjustifiable. Accordingly it is practically impossible to incorporate a water level detector into an existing non-automatic pump to render the pump automatically operable, and automatic pumps equipped with such a detector must be designed initially for automatic operation.

SUMMARY OF THE INVENTION

The present invention provides a water level detecting apparatus of the float type comprising a case supported by a holder and adapted to be placed in water, a float fitting in the case and slidable upwardly or downwardly, a driven member fitting to the float and having a movable attracting portion, an upper fixed attracting member and a lower fixed attracting member disposed above and below the movable attracting portion respectively in opposed relation thereto and spaced apart by a specified distance, a stopper provided at a lower portion of the driven member for supporting the load of the float, a reed switch provided in an upper portion of the case and magnetically operable by the movable attracting portion when the portion moves toward or away from the reed switch, and a contactless switching element comprising an electronic circuit consisting essentially of a TRIAC. The reed switch is electrically connected to the switching element to open or close an actuating circuit for the TRIAC when the switch is operated as above. The movable attracting portion of the driven member is held attracted to the lower fixed attracting member before the level of water rises to a predetermined upper limit, but the portion is moved away from the lower fixed attracting member and attracted to the upper fixed attracting member by the action of the float when the water level reaches the upper limit to operate the reed switch by the change of the position of the movable attracting portion relative to the reed switch. The movable attracting portion is held attracted to the upper fixed attracting member before the water level lowers to a predetermined lower limit, but the portion is moved away from the upper fixed attracting member and attracted to the lower fixed attracting member by the pressure acting on the stopper when the water level reaches the lower limit to reversably operate the reed switch by the change of the position of the movable attracting portion relative to the reed switch. Thus a pump motor can be brought into or out of operation when the TRIAC actuating circuit is opened or closed by the opening or closing of the reed switch at the upper limit level or the lower limit level.

In accordance with the invention there is provided a device for operating an apparatus such as a pump for controlling a water level which comprises a housing in which is located a switch for starting and stopping the apparatus. The switch has magnetically influenced openable and closable contacts which may be operated for example by a magnet carried by a driven member which is associated with the float which floats on the water and changes its level in response to the change of the water level. A movable driven member is connected to the float through a loss motion connection so that movement of the float causes movement of the driven member only after a predetermined amount of level change in response to change of water level. The driven member carries a magnetic actuator for the switch which is moved by the driven member into one position in which it is located in an area to influence the switch to cause its contacts to move to a selected one of either an opened or a closed position. The driven member is movable by changes of level to another position in which it influences the switch to move its contacts so that they are moved in an opposite manner from that of the selected position. The apparatus includes means for holding the magnetic actuator of the driven member by a predetermined force which may be overcome by a predetermined movement of the float only after a predetermined level change. These means may comprise magnetic attractable elements which hold the initial position by magnetic attraction until this magnetic attraction is overcome by the float force due to a substantial water level change. The switch actuator in the invention will then be held in a stable opened or closed position and will be moved smartly to one position of the other only after the predetermined change of the water level. The device is capable of being incorporated on a pump housing for actuation of a pump.

Accordingly it is an object of the invention to provide a pump for other apparatus actuator which will be switched to a first actuating position by change of a water level by a predetermined amount and held in this position until there is a change of water level in an opposite direction by a predetermined amount.

A further object of the invention is to provide an actuator which is simple in design, rugged in construction and economical to manufacture. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1A is a side elevation partly in vertical section and showing an embodiment of the invention;

FIG. 1B is a bottom view of the device shown in FIG. 1A.

FIGS. 2 to 4 are side elevations partly in vertical section showing other embodiments of the invention;

FIG. 5A is a plan view showing a switching element incorporated in the apparatus of the invention;

FIG. 5B is a side elevation partly in vertical section of the switching element shown in FIG. 5A;

DESCRIPTION OF THE PREFERRED EMBODIMENTS

Figure 3:
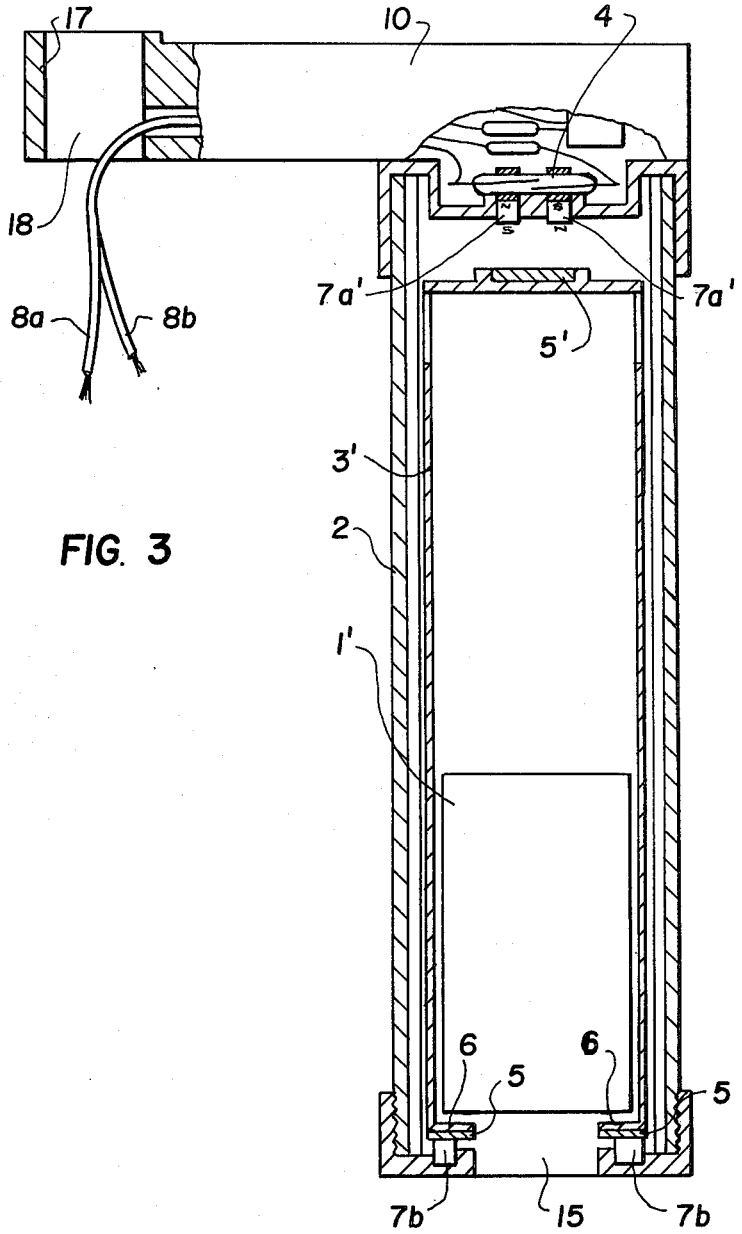

Referring to the drawings, in particular the invention embodied therein, comprises a device for operating an apparatus such as a pump for controlling a water level.

With reference to the drawings, a case 2 has fitted therein a float 1, which is movable upwardly and downwardly. A driven member 3 is movable upwardly and downwardly within the case 2 to follow the vertical movement of the float 1. For example as seen in FIG. 1A and FIG. 2, the driven member 3 comprises an upper portion 3*a* in the form of a short hollow cylinder so as to be movable upwardly and downwardly externally around a reed switch 4 and a lower portion 3*b* in the form of a slender rod extending through a vertical bore 1*a* in the float 1.

Figure 4:
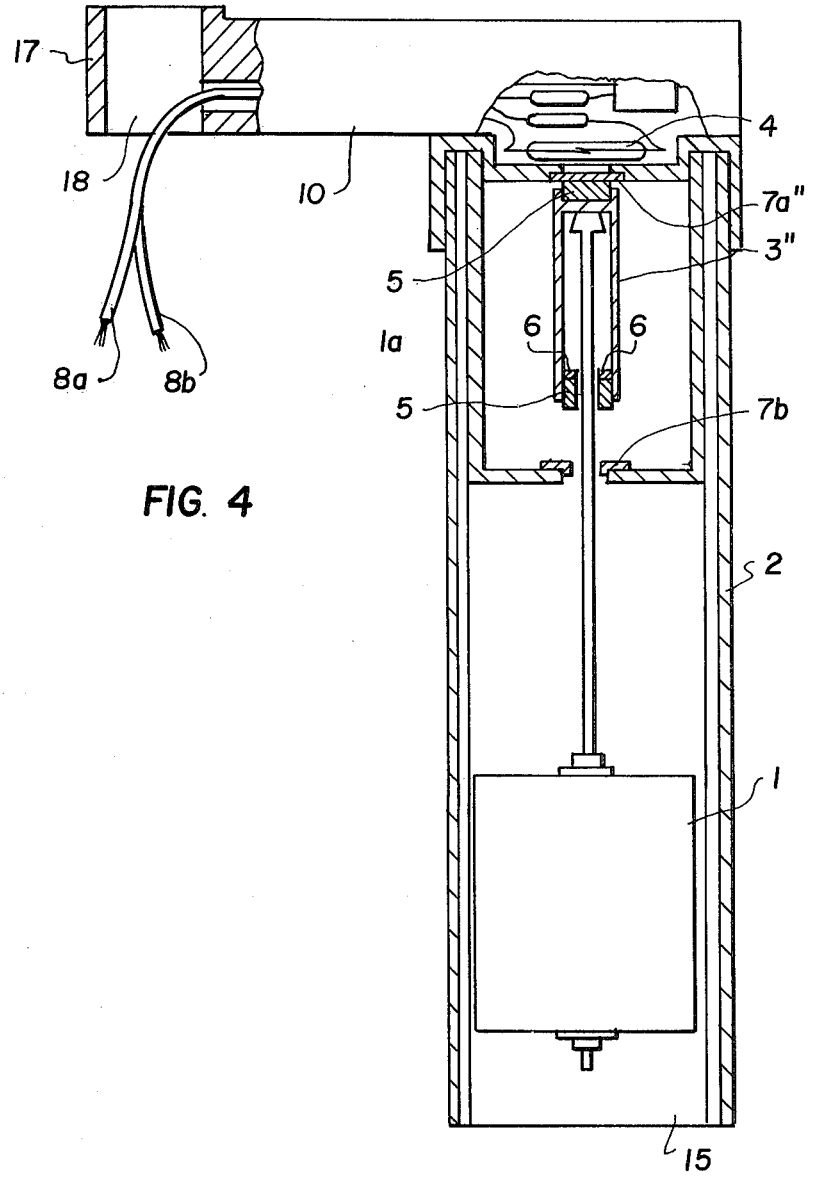

In the embodiment according to FIG. 3, the driven member 3' is in the form of a frame having a float 1' vertically movably housed therein as shown in FIG. 3. Further as seen in the embodiment of FIG. 4, the driven member 3'' is in the form of a short hollow cylinder. An extension 1*a* of the float 1 extends into the cylinder 3'' and is vertically movable with the float. In both of these forms, the driven member 3' and 3'' have a movable attracting portion or magnet 5' and 5'' respectively opposed to an upper fixed attracting member 7*a* and 7*b* or 7*a'* disposed thereabove and to a lower fixed attracting member 7*b* disposed therebelow. The driven member 3' has a stopper 6 at its lower portion for supporting the load of the float 1 in a lowermost position. The stopper 6 may be engageable with the float 1 directly or with the neck portion of the extension 1*a* to indirectly support the load of the float 1'. A reed switch 4 is disposed in an upper portion of the case 2. The fixed attracting members 7*a'*, 7*b* in FIG. 3 are spaced apart by a predetermined distance. When moving toward or away from the reed switch 4, the movable attracting portion 5 produces a varying magnetic action, by which the reed switch is opened or closed. The portion 5 is adapted to be held attracted to either one of the attracting members 7*a'* and 7*b*, as separated from the other.

The movable attracting portions 5 of FIGS. 1A, 2, 3 and 4 may be a magnet, for example, and the upper and lower fixed attracting members 7*a*, 7*b* may be made of soft iron. The movable attracting portion 5 shown in FIG. 1A is a magnet. When is is brought into contact with the upper attracting member 7*a* as it moves away from the lower attracting member 7*b* of soft iron, the reed switch, which is usually open, is closed. The reed switch 4 is returned to the open state when the portion 5 is brought into contact with the lower attracting member 7*b*. Alternatively the upper and lower fixed attracting members 7*a*, 7*b* may be made of a magnet, while the movable portion 5 may be made of soft iron as seen in FIG. 2. The portion 5; when coming into contact with the upper attracting member 7*a*, closes the usually open reed switch 4 (which is held open by member 7*a*). Since portion 5 is made of soft iron, it cuts the magnetic lines of force produced by member 7*a* when 5 contacts 7*a*, to allow switch 4 to close. When coming into contact with the lower attracting member 7*b* against the upper member 7*a*, the movable portion 5 opens the reed switch 4. The portion 5 is moved away from the ower member 7*b* by the movement of the float 1 when the water level reaches a predetermined upper limit, such that the portion 5 is separated from the lower member 7*b* instantaneously and brought into contact with the upper member 7*a* at the same time. The movable portion 5 is separated from the upper member 7*a* by the pressure acting on the stopper 6 when the water level reaches a predetermined lower level, such that the portion is moved away from the upper member 7*a* into contact with the lower member 7*b* instantaneously. Thus the reed switch 7 is opened or closed instantaneously and is also held opened or closed stably.

Figures 7A, 7B, 7C, 7D:
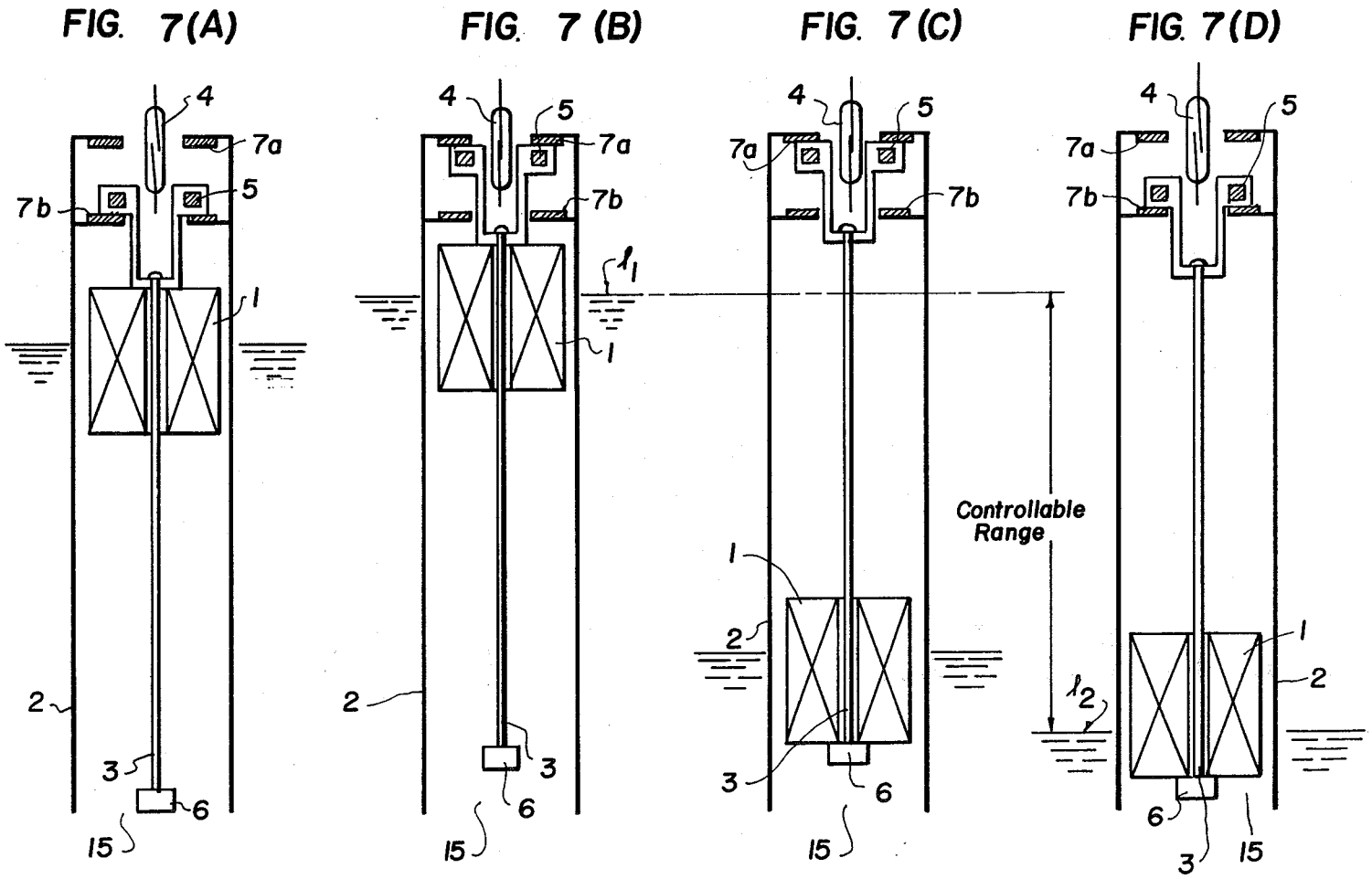
FIGS. 7A to 7D are diagrams illustrating the operation of the present apparatus.
Figure 8A:
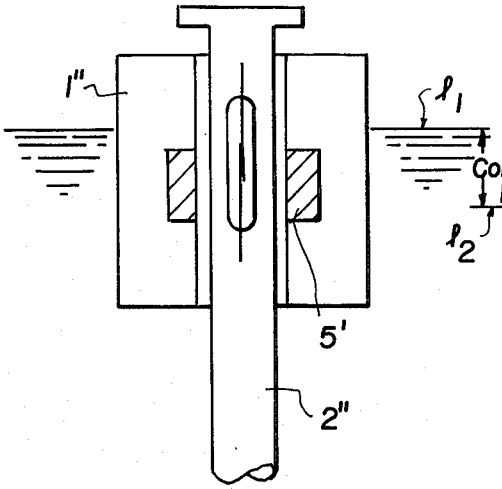
FIG. 8(A) (PRIOR ART)
FIGS. 8A and B are diagrams illustrating the operation of a water level detector used for conventional underwater pumps.
Figure 8:
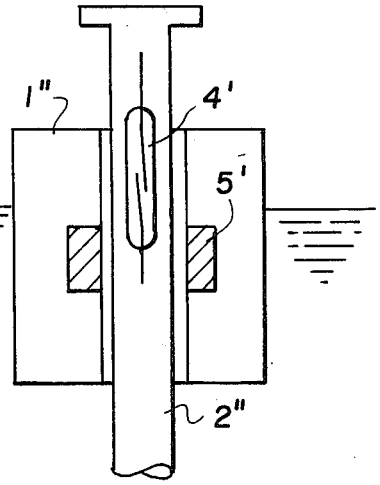
FIG. 8 (B) (PRIOR ART)

The operative relation between the float 1 and the driven member 3 will be described in greater detail. The float and the driven member are so designed that the buoyant force of the float 1 floating in the usual state during the rise of the water level is slightly smaller than the force restraining the driven member from rising which force is equal to the force of attraction between the lower fixed attracting member 7*b* and the movable attracting portion 5 plus the load of the driven member 3. They are further so designed that the upward restoring force of the float when it is entirely submerged is greater than the restraining force and that the force of attraction between the upper attracting member 7*a* and the movable portion 5 is slightly greater than the force acting to lower the driven member 3 under gravity but is smaller than the increased lowering force afforded by the weight of the driven member 3 and the weight of the float 1 on the surface of the water when the float 1 is to leave the water. Accordingly even when the float 1 acts to push up the driven member 3 while rising with the rise of the water level, the driven member 3 remains in its lowered position without rising, with the movable attracting portion 5 held attracted to the lower member 7*b* as seen in FIG. 7 (A). As the water level further rises in this state, the submerged volume of the float 1 prevented from rising increases. When the water level reaches the upper limit $l_1$ (FIG. 7B) with an increase in the submerged volume of the float 1, the buoyant force accumulated in the float l overcomes the force of attraction between the portion 5 and the lower member 7*b*, whereupon the upward restoring force of the float 1 pushes up the driven member 3, instantaneously moving the portion 5 out of contact with the lower member 7*b* into contact with the upper member 7*a* and opening or closing the switch 4 simultaneously (FIG. 7 (B)). The portion 5 is forced away from the lower member 7*b* into contact with the upper member 7*a* instantaneously magnetically. After the reed switch 4 is opened or closed at the upper limit level, the switch 4 is held open or closed with the portion 5 held attracted to the upper member 7*a* without any likelihood of chattering due to waves on the water surface or the like. Further even when the float l acts to lower the driven member 3 while descending with a fall of the water level, the driven member 3 remains in its raised position without lowering, with the portion 5 held attracted to the upper member 7*a* as seen in FIG. 7 (C). As the water level further falls with the float 1 in engagement with the stopper 6, the submerged volume of the float l decreases. When the water level reaches the predetermined lower limit $l_2$ with a decrease in the submerged volume of the float 1, the resulting increased pressure on the stopper 6 acts to lower the driven member 3 against the force of attraction, forcing the movable portion 5 out of contact with the upper member 7*a* into contact with the lower member 7*b* as seen in FIG. 7 (D) and closing or opening the read switch 4 at the same time. The portion 5 is thus moved magnetically instantaneoulsy. Afther the reed switch 4 is closed or opened at the lower limit level, the switch 4 is held closed or open with the portion 5 held attracted to the lower member 7*b* without any likelihood of chattering due to waves on the water surface or the like. In this way the present apparatus operates reliably.

The present apparatus further includes a contact less switching element 8 comprising an electronic circuit consisting essentially of a TRIAC 9, (FIGS. 5(A) and FIG. 5(B)). The element 8 is housed in a holder 1O supporting the upper end of the case 2. Lead wires 4*a*, 4*b* extending from the contact pieces of the reed switch 4 are connected to the input terminals of the element 8 (FIG. 6(B)) while a power supply lead wire 8*a* and a loading lead wire 8*b* extend from the output terminals thereof. Thus the reed switch 4 is electrically connected to the switching element 8 so as to open or close an actuating circuit for the TRIAC 9 when opened or closed by the approach or retreat of the movable attracting portion 5 with the movement of the driven member 3 due to the movement of the float 1. FIGS. 5 (A) and (B) show a mount 11 for the TRIAC 9, heat releasing fins 12, resistors 13 and a capacitor 14. The case 2 is formed, for example, with a lower water opening 15 at its bottom and upper water openings 15' at an upper portion of its wall (FIGS. 6 (A) and (B)) to render the float 1 smoothly movable upward or downward with the rise or fall of the water level. The case 2 is fitted or screwed in the base portion of the holder 10.

The apparatus of this invention will be used for automatically controlling the operation of an underwater pump 25 in the following manner.

Figure 6:
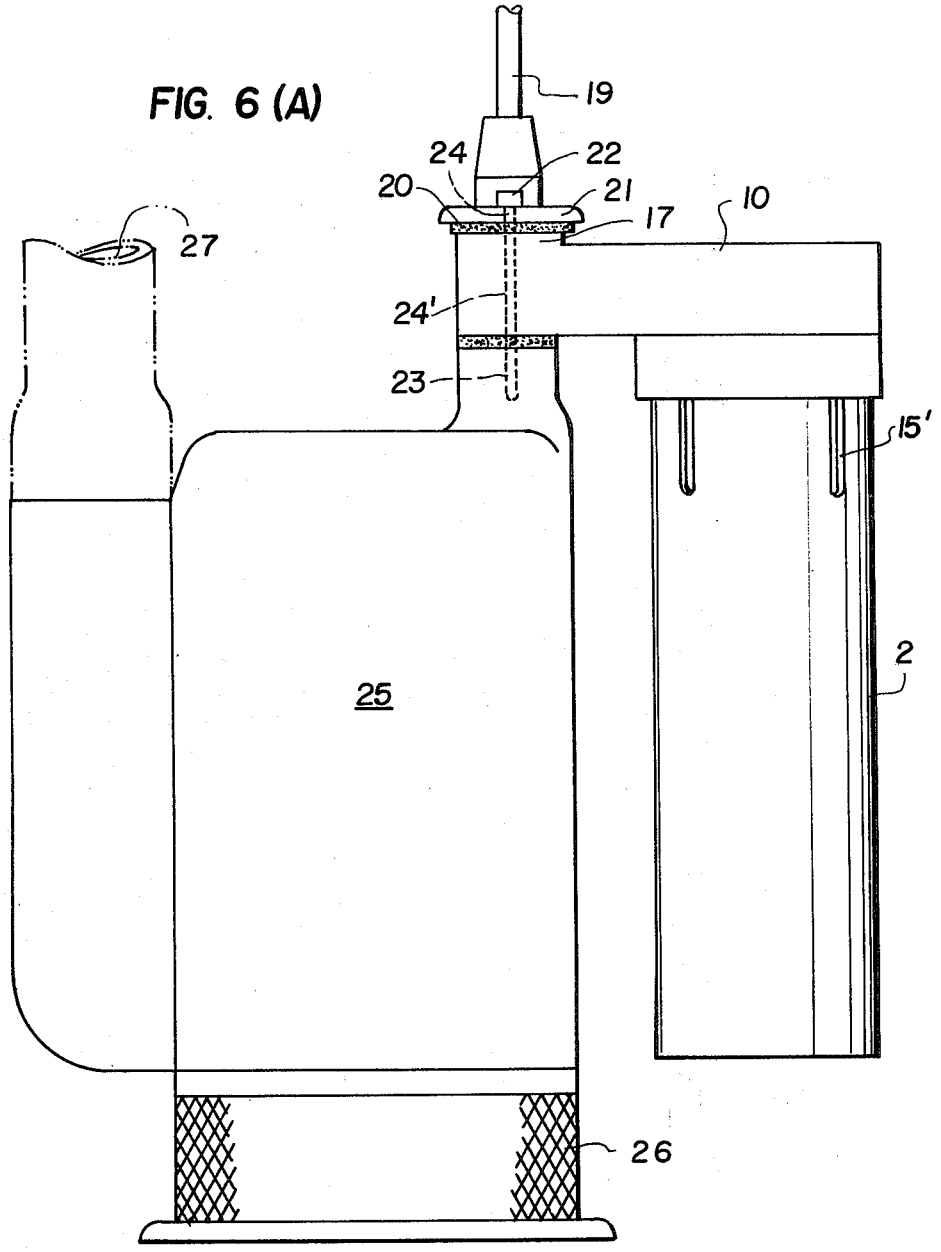
FIG. 6A is a side elevation showing the water level detecting apparatus of the invention as attached to an existing underwater pump.
FIG. 6B is a side elevation partly in vertical section of the pump shown in FIG. 6A.
Figure 6:
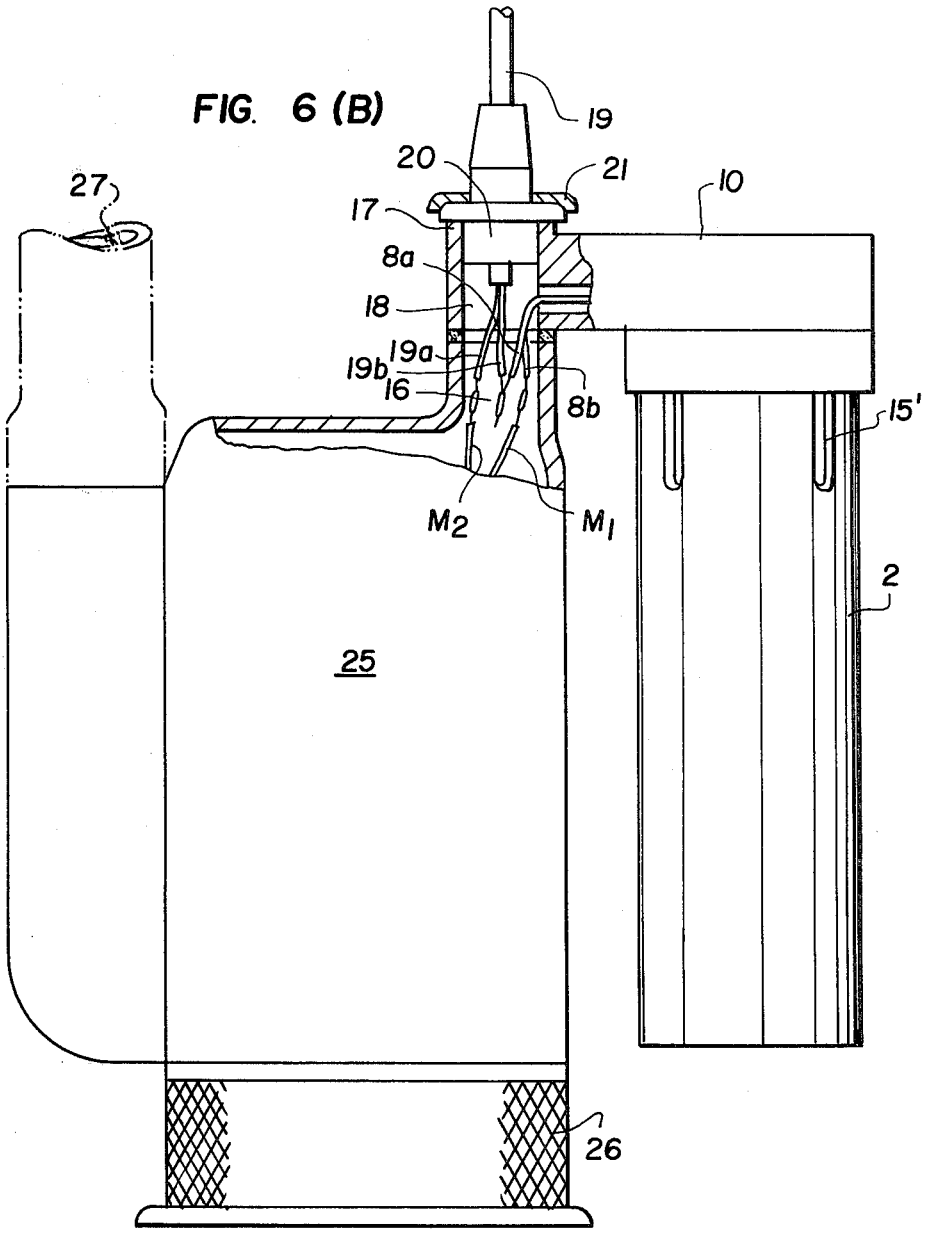

The forward end of the holder 10 is formed with an attaching portion 17 to be fitted to a wire outlet 16 at an upper portion of the pump 25 as shown in FIGS. 6 (A) and 6 (B). The attaching portion 17 is centrally formed with a bore 18 to communicate with the outlet 16. The output wires 8*a*, 8*b* of the switching element 8 are led out through the bore 18 and individually connected to one wire 19*a* of a power supply cord 19 and one wire M1 from the motor. With the cord 19 extending thorugh a watertight seal member 20 above the bore 18, the attaching portion 17 is fastened to the outlet portion 16 by a holding cover 21 and a bolt 22.

The attaching portion 17 has a bolt hole 24' in alignment with a screw hole 23 formed in the outlet portion 16 and with a bolt hole 24 formed in the cover 21. The bolt 22 is inserted through the holes 24, 24' and screwed into the hole 23, whereby the holder 10 is attached to the upper portion of the pump 25, with the case 2 extending downward at one side of the pump 25 as seen in FIGS. 6(A) and (B). The other wire 19*b* of the cord 19 is connected directly to the other wire M2 from the motor. The pump 25 has a water inlet 26 and a water outlet 27.

The underwater pump 25 is used, for example, for discharging water from a tank in the manner to be described below with reference to FIGS. 7 (A) to (D). When the float 1 within the case 2 rises as seen in FIG. 7 (A) as the water level within the tank rises gradually with the flow of water into the tank, the movable attracting portion 5 remains attracted to the lower fixed attracting member 7*b* to prevent the driven member 3 from rising before the water level reaches the upper limit $l_1$. Upon the water level reaching the upper limit $l_1$, the float l acts to move the portion 5 away from the member 7*b* into contact with the upper member 7*a* (see FIG. 7 (B)), thereby magnetically closing the reed switch 4 to bring the output circuit of the switching element 8 into conduction. The pump 25 operates, drawing water into the inlet 26 and discharging the water from the outlet 27 to discharge the water from the tank. Even when the water level within the tank consequently falls and lowers the float 1 as seen in FIG. 7 (C), the movable portion 5 remains attracted to the upper member 7*a* to prevent the driven member 3 from lowering before the level reaches the lower limit. With the reed switch 4 held closed, the pump 25 is held in operation to continuously discharge water. When the water level reaches the lower limit $l_2$ with a further fall, the pressure acting on the stopper 6 moves the attracting portion 5 of the driven member 3 out of contact with the upper member 7*a* into contact with the lower member 7*b* as seen in FIG. 7 (D), magnetically opening the reed switch 4 to break the output circuit of the switching element 8 and stop the operation of the pump 25. In this way the pump is automatically controlled by instantaneously and smoothly detecting the water level at two positions, i.e. the predetermined upper limit $l_1$ for starting the pump and the predetermined lower limit $l_2$ for stopping the pump.

Unlike the above mode of use, it is also possible to install the pump within a tank for supplying water into the tank from an external source. In this case, the movable attracting portion 5 and the upper and lower fixed attracting members 7*a*, 7*b* are arranged in the mode shown in FIG. 2 to start the motor at a predetermined lower limit water level for supplying water and to stop the motor for the interruption of supply when the water level reaches a predetermined upper limit. In either case, the range of effective movement of the float 1 can be set as desired by suitably determining the axial lengths of the float 1 and the driven member 3, whereby the distance between the upper limit $l_1$ and the lower limit $l_2$ for the water level, namely the control range, can be set as desired.

The water level detecting apparatus of the float type according to the invention has the following advantages over the conventional detectors of the same type. First, the driven member is held at rest by a force of magnetic attraction when the water level reaches a specified upper limit, while the float and the driven member are greatly spaced from the reed switch with the driven member magnetically held at rest when the water level reaches a specified lower limit, so that the reed switch can be held closed or open without any chattering even in the presence of waves. Second, since the reed switch is quickly operated only at the upper limit and lower limit, the water level can be detected properly at two positions with use of the single apparatus. Moreover the distance between the upper limit and the lower limit of the water level, namely the water level control range, can be set as desired by suitably determining the distance of effective movement of the float. Because a water pump is automatically controllable without the necessity of using two water level detectors for starting the pump at the upper limit and for stopping the pump at the lower limit which are conventionally employed, there is no need to use a complex arrangement externally of the pump. Third, the operation of the reed switch is transmitted to the motor circuit through the contactless switching element having an electronic circuit consisting essentially of a TRIAC, so that the motor circuit produces no spark upon energization or de-energization and can therefore be sealed off advantageously. The switching element, which is contactless, is resistant to vibration and usable for a prolonged period of time. The apparatus is much smaller and more inexpensive than the conventional arrangement wherein a power relay and transformer are used. Fourth, the switching element is housed in the holder, that is, the element is incorporated in the water level detecting apparatus, so that there is no need to accommodate a transformer or power relay in the motor and therefore to prepare a new head cover for providing the accommodating space conventionally needed for modifying an existing non-automatic pump to an automatic pump. According to the invention, an existing pump can be made automatically controllable only by attaching the holder to the head cover of the pump motor. The pump so modified can be changed to the original non-automatic pump readily by removing the holder from the head cover.

While specific embodiments of the invention have been shown and described in detail to illustrate the application of the principles of the invention, it will be understood that the invention may be embodied otherwise without departing from such principles.

What is claimed is:

1. A device for operating an apparatus such as a pump for controlling a water level, comprising a housing, a switch mounted in said housing for starting and stopping the apparatus and having a magnetically influenced openable and closable contact, a float in said housing floatable on the water level to be controlled and changing in level with the change of water level, a movable driven member associated with said float in said housing, means establishing a loss motion connection between said float and said driven member causing movement of said float upon change of water level by a predetermined amount before causing movement of said driven member in each direction of level change, said driven member having a magnetic actuator actuating the contacts of said switch positionable by movement of said float into a first position to locate said actuator in an area in which it influences said switch to cause its contacts to move to a selected one of an opened and closed position, and being movable to a second position spaced away from said first position upon movement of said float to a different level in which it influences said switch to move its contacts to the opposite direction of the selected position, holding means holding said magnetic actuator in said first and second positions by a predetermined holding force which may be overcome by movement of said float only after a predetermined change of level, said holding means comprising a pair of magnetic holders, one for holding said magnetic actuator in each of said first and second positions.

2. A device according to claim 1, wherein said means for establishing a loss motion connection between said driven member and said float comprises a bore through said float, a driven member comprising a rod extending through said bore, a stopper member connected to the end of said driven member which extends through said bore, the opposite end of said driven member comprising a cylindrical member having an open top end, said open top end being movable around said switch upwardly and downwardly.

3. A device according to claim 1, wherein said means establishing a loss motion connection between said float and said driven member comprises a fixed connection of said driven member to said float at its one end and having an opposite end, a cylinder surrounding said driven member opposite end, said driven member being movable in said cylinder and having an abutment portion which pushes against said cylinder to move it in one direction to actuate said switch and is movable in an opposite direction by a predetermined amount before it contacts the opposite end of said cylinder to move it in an opposite direction.

4. A device according to claim 1, wherein said means establishing a loss motion connection between said driven member and said float comprises a frame in said casing surrounding said float, said float being movable upwardly and downwardly in said frame, said driven member comprising said frame being movable upon predetermined movement of said float in each direction within said frame.

5. A device according to claim 1, wherein said switch comprises a reed switch located in the upper portion of said housing and a contactless switching element comprising an electronic circuit essentially including a TRIAC, said reed switch being electrically connected to the apparatus and wherein said holding means comprises a magnetic holder.

6. A device according to claim 1, wherein said means establishing a loss motion connection comprises a frame element forming said driven member surrounding said float and being opened at the bottom having inwardly directed flange at its bottom holding said float so that it can escape from said bottom, said float being movable upwardly upon liquid level change to the top of said frame member to cause then subsequent movement of said frame member, one of said magnetic holders comprising a magnet on the end of said frame member adjacent said switch and also comprising said magnetic actuator.

7. A device according to claim 1, wherein said driven member comprises a rod connected to said float, said means establishing a loss motion connection between said driven member and said float comprising a separate driver element in the form of a cylinder overlying said rod, said rod having a projection located within said cylinder and being such that it will not disassociate from said cylinder but is movable relative to said cylinder, said cylinder carrying a magnet at is one end adjacent said switch comprising said magnetic actuator.

8. A device according to claim 7, including the frame surrounding said cylinder having an opening therethrough to which said rod extends to said float and one of said magnetic holders associated with said frame adjacent the opening for said rod for holding said cylinder in an end position.

9. A device according to claim 1, wherein said switch comprises a normally open switch which is closed by said magnetically operable actuator.

10. A device according to claim 1, wherein said housing forms an extension and including a pump engaged under said extension connected to said housing and means establishing electrical contact between said switch and said pump for actuating said pump.

11. A device according to claim 1, wherein said switch comprises a reed switch located in the upper portion of said housing and a contactless switching element comprising an electronic circuit essentially including a TRIAC, said reed switch being electrically connected to the apparatus, said means establishing a loss motion connection comprising said float being movable along said rod between said cylinder and said stopper member, the cylinder having said magnetic actuator at the upper end thereof surrounding said switch, means guiding said magnetic actuator between said first and second positions relative to said switch, said magnetic holders comprising magnetically attractable elements disposed at each position of said actuator.

* * * * *